US005331935A

United States Patent [19]

Daino

[11] Patent Number: 5,331,935

[45] Date of Patent: Jul. 26, 1994

[54] AUXILIARY IGNITION SYSTEM AND METHOD FOR AIRCRAFT ENGINES

[75] Inventor: John Daino, Wallingford, Pa.

[73] Assignee: ASAP - Aircraft Service and Parts, Inc., New Castle, Del.

[21] Appl. No.: 40,900

[22] Filed: Mar. 31, 1993

[51] Int. Cl.[5] ..... F02P 1/08

[52] U.S. Cl. ..... 123/424; 123/179.5; 123/639; 123/640

[58] Field of Search ..... 123/640, 639, 424, 179.5, 123/186.1, 179.29, 179.27, 641

[56] References Cited

U.S. PATENT DOCUMENTS 1,862,116 6/1932 Hicks ..... 123/641

2,380,707 7/1945 Sawyer ..... 123/641

OTHER PUBLICATIONS

Teledyne Continental Motors, "The ABC's of the TCM Shower of Sparks Ignition System", Oct. 1990.

*Primary Examiner*—Andrew M. Dolinar

*Attorney, Agent, or Firm*—Eugene E. Renz, Jr.

[57] ABSTRACT

An auxiliary ignition system comprising a first magneto having a normal operating mode and a start-up mode, and a second magneto having a normal operating mode and a start-up mode. A primary starter switch is operably wired to the first and second magnetos. Engagement of the primary starter switch activates the second magneto start-up mode and the first magneto start-up mode. Auxiliary ignition switches are operably connected to the primary starter switch wiring such that engagement of the auxiliary ignition switches after engagement of the starter switch causes the first and second magnetos to initiate engine ignition in their respective normal operating mode.

12 Claims, 4 Drawing Sheets

AUXILIARY IGNITION SYSTEM AND METHOD FOR AIRCRAFT ENGINES

FIELD OF THE INVENTION

The present invention relates to an improvement in aircraft engine dual magneto ignition systems, and specifically to an auxiliary ignition system effective to allow engine start-up in the event of failure to the starter vibrator unit or in the first magneto starting circuit.

BACKGROUND OF THE INVENTION

Most aircraft and helicopter engines use dual magneto systems to provide current impulses to the engine spark plugs during normal operation. In the event of a magneto failure, the remaining magneto in the pair continues to provide current impulses to maintain engine performance. Once a magneto is in operation, no external power is required to maintain the magneto's operation. Only during engine start-up is an external power supply, usually battery power, used to rotate the magnetos by turning the engine over by the engine starter motor. Each magneto has a so-called "P-lead" which, if grounded, disables the magneto from providing current impulses to the engine spark plugs.

Some aircraft ignition systems provide for boosted engine ignition during the engine start-up sequence through the use of a battery operated spark booster device, commonly known as a starter vibrator or "shower of sparks" for the first magneto only. The shower of sparks ignition system is described in the publication entitled "The ABC's of the TCM Shower of Sparks Ignition System" by Teledyne Continental Motors, the manufacturer. The starter vibrator or shower of sparks provides an enhanced AC current to the first magneto to supplement the single current impulses obtained from the first magneto to facilitate engine start-up. A retard breaker circuit is also activated in the first magneto during engine start-up which delays the function of the running points via the retard or starting points so that the starting points will not effectively open until very near top dead center, or "TDC". In the normal operation of the first magneto the running points, also known as the switch or advance points, are set to open 22° before top dead center, or "BTDC". This relative delay in the opening of the starting points as compared to the running points prevents kick-back which occurs if the spark plugs spark prematurely during the relatively slow rotational speed of the magnetos during engine start-up. The second magneto is grounded during engine ignition to prevent the second magneto from providing current impulses via its running points. This prevents engine kick-back.

When the pilot is prepared to attempt engine ignition, the starter switch, a plurality of tandem switches operating simultaneously, is engaged whereby the second magneto is grounded through its P-lead, and the starter vibrator and the retard breaker circuit are activated for the first magneto. Simultaneously, a battery operated engine starter motor turns the engine over which also causes the first and second magnetos to rotate. Only the first magneto's starting/running points provide current impulses, to which the enhanced AC current from the starter vibrator is added, which is normally adequate to initiate engine ignition. Once the engine starts, the starter switch is disengaged which deactivates the engine starter motor and breaks the grounding circuit for the second magneto causing it to provide current impulses via its running points. The starter vibrator and the retard breaker circuit are also simultaneously deactivated once the starter switch is disengaged and the first magneto also then provides current impulses via its running points. The engine continues to operate until and unless the magnetos are grounded via their respective P-leads at normal engine shut-down.

In the event of a malfunction of the starter vibrator or the first magneto starter circuit, the engine will not start. The aircraft must then be serviced by a mechanic. This delays the aircraft and, if parts are unavailable to replace or repair the malfunction, the delay may be considerable. Small aircraft are more likely to fly to remote areas or smaller airports where mechanics and replacement parts are not readily available. Adverse conditions, such as inclement weather especially during the winter months, may also prevent the engine from starting normally. Since a battery is used to power both the engine starter motor and starter vibrator, a limited opportunity is available to initiate engine ignition before the battery is depleted.

SUMMARY OF THE INVENTION

With the foregoing in mind, it is the object of the present invention to provide an auxiliary ignition system for aircraft engines which obviates the shortcomings of the prior ignition systems and which is characterized by novel features of construction and arrangement facilitating engine ignition upon malfunction of either the starter vibrator or the first magneto starting circuits. The auxiliary ignition system of the present invention may be used with small airplanes, helicopters, and other dual magneto ignition systems with single or multiple engines which use starter vibrators, or showers of sparks.

This object is achieved by the auxiliary ignition system of the present invention by placing auxiliary ignition switches within the normal starting circuit activated by the starter switch between the magnetos and the start switches. Engagement of the auxiliary ignition switches allows both first and second magnetos to provide ignition current impulses via their running points only to attempt engine ignition. To minimize the potential for engine kick-back, the starter switch is engaged first to achieve maximum start-up rotational speed of the first and second magnetos by the engine starter motor before the auxiliary ignition switches are engaged. The engagement of the first magneto auxiliary ignition switch disengages the retard breaker circuit, normally engaged by the starter switch, allowing the first magneto to provide current impulses via its running points only. The second magneto auxiliary ignition switch breaks the circuit to the ground of the second magneto's P-lead normally engaged by the starter switch, allowing the second magneto to provide current impulses via its running points concurrently with the first magneto.

After engine ignition, the starter switch is disengaged first, then the auxiliary ignition switches are disengaged and the engine performs normally. The running circuits of the engine is completely unaffected and unaltered by the auxiliary ignition system switches. Once the aircraft reaches an airport with the necessary replacement parts and/or maintenance personnel, the malfunctioning starting ignition circuit and/or starter vibrator is repaired or replaced as necessary. The engines may be safely and reliably started by the use of the auxiliary ignition system and method of the present invention without engine kick-back.

The auxiliary ignition system and method of the present invention could also be useful in a situation when an engine is flooded with fuel. Such "fuel soaked" spark plugs make starting difficult. The auxiliary ignition system utilizes both magnetos of each engine which doubles the amount of firing spark plugs during the start sequence. This facilitates more rapid expulsion of the excess fuel.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
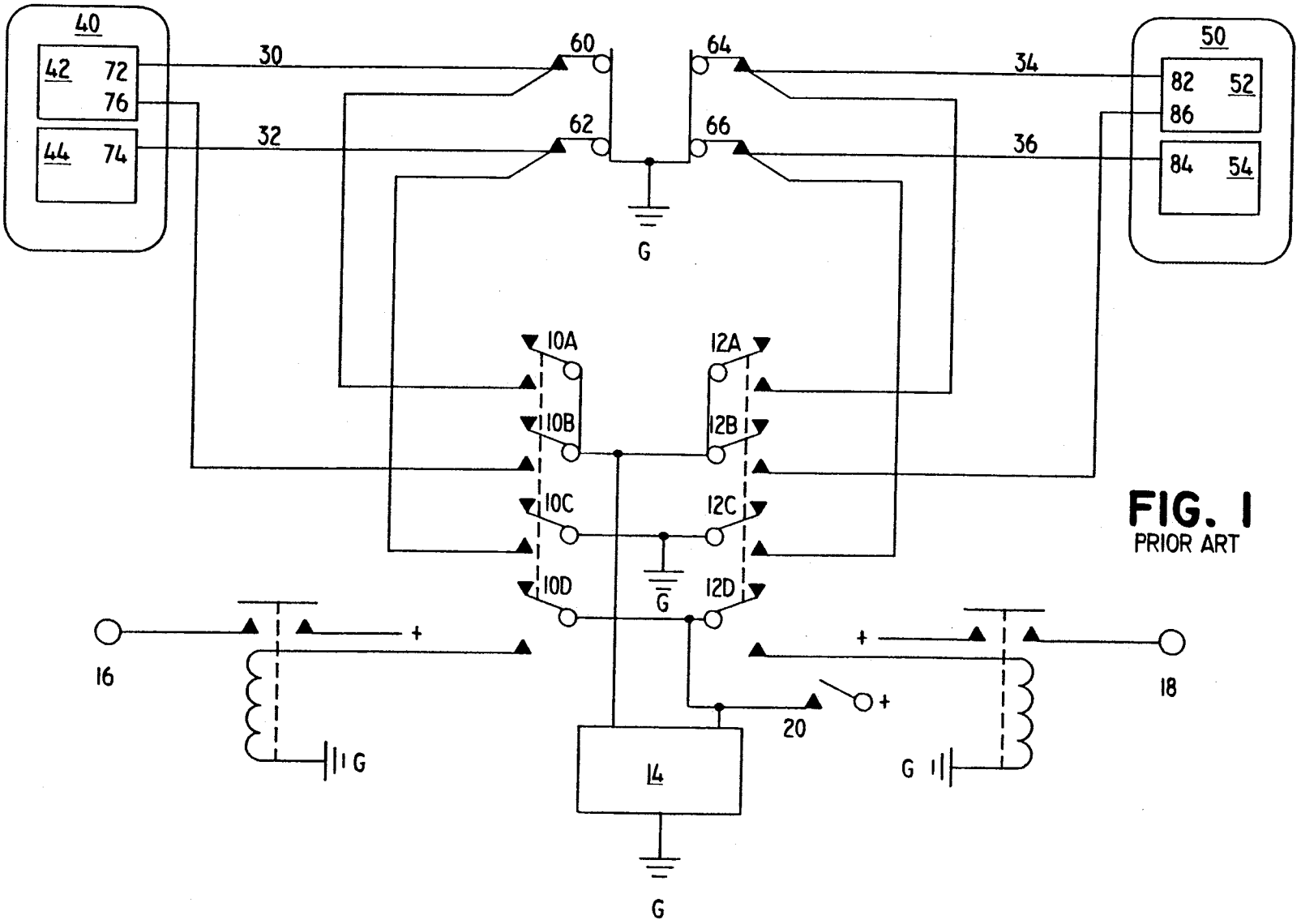
FIG. 1 PRIOR ART
FIG. 1 is a greatly simplified schematic wiring diagram of a small, two engine dual magneto aircraft showing use of the standard, prior art normal starting circuit in the full off position.

Referring now to the drawings, and specifically to FIG. 1, there is illustrated a greatly simplified schematic wiring diagram of the prior art starting circuit for a two engine, dual magneto small aircraft in the full off position. First engine 40 and second engine 50 each include a first magneto 42,52 and a second magneto 44,54, respectively. Each magneto 42,44; 52,54 of each engine 40,50 is wired through its P-lead 30,32; 34,36 to its respective magneto switch 60,62; 64,66 which, when closed as shown in FIG. 1, connect the respective magnetos to ground G and prevents the magnetos from supplying current impulses to the engine spark plugs (not shown) upon rotation of the magnetos. Each second magneto 44,54 includes a running points circuit 74,84 which, when engaged, allows the magneto's running points to provide current impulses in the normal operational mode. Each first magneto 42,52 includes an analogous running points circuit 72,82 and running points and also a retard breaker circuit 76,86 which, when engaged during normal engine start-up, causes delayed operation of the magnetos running point circuit to provide current impulses.

The magnetos 42,44; 52,54 are further wired via first and second engine multiple contact start switches 10A,10B,10C,10D; 12A,12B,12C,12D. As shown in FIG. 1, these first and second engine multiple contact start switches 10A,10B,10C,10D; 12A,12B,12C,12D, respectively, are in the disengaged position. A master switch 20, also shown in the disengaged position, is wired to the starting circuit and which, when engaged, provides power to the starting circuit. A starter vibrator 14 is wired to the master switch 20, and to each first magneto running point circuit 72,82 and retard breaker circuit 76,86 only when the first engine or second engine start switches 10A,10B; 12A,12B, respectively, are in the engaged positions. The engine multiple contact start switches 10A,10B,10C,10D; 12A,12B,12C,12D are also wired to the first and second engine starter motors 16,18, respectively.

Figure 2:
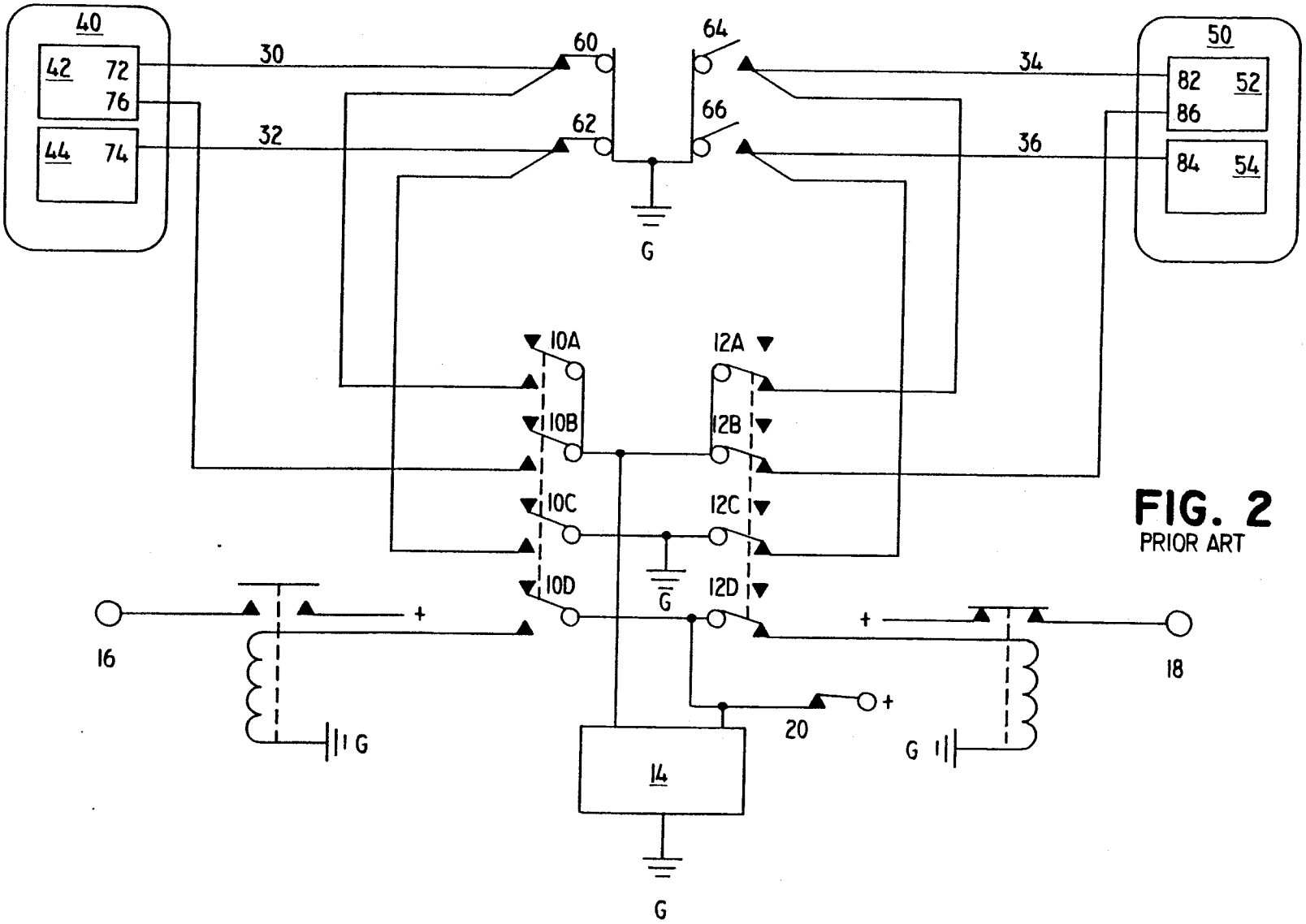
FIG. 2 PRIOR ART
FIG. 2 is a schematic wiring diagram of FIG. 1 during start-up of the second engine.

FIG. 2 illustrates the starting of the second engine 50 of the prior art starting circuit of FIG. 1. The second engine magneto switches 64,66 are first placed in the open position as shown. The first and second magnetos 52,54 are thus removed from the ground G, and any rotation of the magnetos 52,54 would produce current impulses to the right engine spark plugs unless the magnetos 52,54 are otherwise grounded or disabled. Master switch 20 is then placed in the engaged position, as shown in FIG. 2, which energizes the aircraft starting circuit. When the pilot is prepared to start the second engine 50 he or she engages the second engine starter 18 by placing the second engine multiple contact start switch 12A,12B,12C,12D in the engaged positions as shown, which also activates the battery powered starter vibrator 14 and provides an enhanced AC current to the first magneto 52 as will be more fully described hereafter. The engagement of the second engine start switch 12A,12B,12C,12D engages the battery operated second engine starter motor 18 which rotates the second engine 50 and in turn rotates the first and second magnetos 52,54.

The rotation of the magnetos 52,54 would produce current impulses to the second engine spark plugs via both magnetos simultaneously. To avoid engine kick-back, the second magneto 54 is grounded via a contact 12C in the engine start switch 12A, 12B, 12C, 12D, and as shown in FIG. 2. Therefore, only the first magneto 52 is permitted to provide current impulses to the right engine spark plugs. The retard breaker circuit 86 of the first magneto 52 is engaged via contacts 12A,12B in the second engine start switch as shown and causes a delayed function of the running points of the first magneto 52 via the starting points. The timing of the starting points to open very near top dead center avoids kick-back of the engine due to the relatively low start-up rotational speed of the second engine 50. Simultaneously, the starter vibrator 14 provides an enhanced AC current, or a "shower of sparks", to enhance rapid engine ignition, thus preserving the battery used to power both the engine starter motor 18 and the starter vibrator 14.

Once the second engine ignition is achieved, the pilot disengages the second engine multiple contact start switch 12A,12B,12C,12D which in turn disengages the second engine starter motor 18, and the starter vibrator 14. The second magneto 54 is no longer grounded by the second engine start switch 12C and its running points provide current impulses. The retard breaker circuit 86 of the first magneto 52 is disengaged due to the disengagement of the second engine start switches 12A,12B and the first magneto provides current impulses via its running points concurrently with the second magneto 54.

The start-up of the first engine 40 occurs in a similar fashion using the first engine starting circuit.

In summary, the prior art starting circuit system as described above grounds the second magneto 44,54 during engine start-up to avoid engine kick-back. The retard breaker circuit 76,86 of the first magnetos 44,54 is engaged, which delays the opening of the running points via the starting points of the first magnetos 44,54 to avoid engine kick-back during the relatively slow rotational speed of the engine 40,50 by the engine starter motor 16,18 at initial engagement of the engine multiple contact start switch 10A,10B,10C,10D;

12A,12B,12C,12D. The starter vibrator 14 provides an enhanced AC current for the first magneto 42,52 to enhance rapid engine ignition and conserve the aircraft's battery supply.

Figure 3:
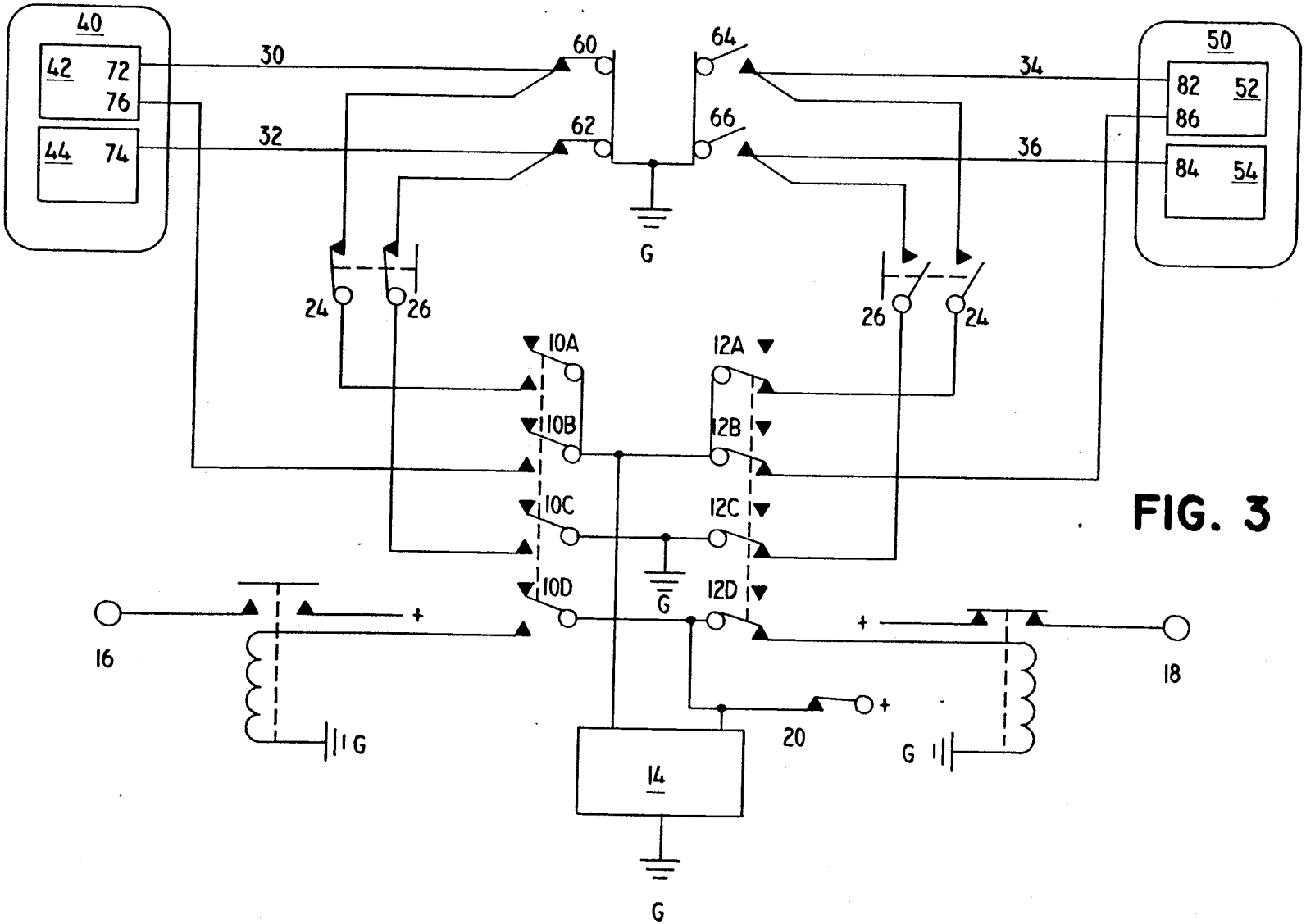
FIG. 3 is a schematic wiring diagram of FIG. 2 with the auxiliary ignition system of the present invention in use during start-up of the second engine.

In the event of a malfunction of the starter vibrator 14 or either first magneto starting circuit, the engine or engines will not start and the aircraft will be grounded until serviced by maintenance personal. As shown in FIG. 3, the auxiliary ignition system of the present invention includes two switches 24,26 operably placed in each starting circuit which, when engaged, counteracts the grounding of the second magneto 44,54 and the engagement of the retard breaker circuit 76,86 of the first magnetos 42,52. Specifically, auxiliary ignition switch 24 is placed in the P-lead circuit for the first magneto 42,52 between the magneto 42,52 and the contacts 10A,12A of the engine start switch. Similarly, auxiliary ignition switch 26 is placed in the P-lead circuit for the second magneto 44,54 between the magneto 44,54 and the contacts 10C,12C of the start switch. The auxiliary ignition start switches 24,26 may be toggle switches, relay switches or their equivalents, or circuit breakers or their equivalents.

If the second engine 50 fails to start by the use of the prior art aircraft starting circuit and method as shown in FIG. 2 and as described above, the auxiliary ignition switches 24,26 may be utilized to attempt engine ignition as shown in FIG. 3. The pilot would first engage the right engine multiple contact start switch 12A,12B,12C,12D, which in turn engages the second engine starter motor 18 to rotate the second engine 50 causing the magnetos 52,54 to rotate. The first and second magnetos 52,54 operate as described above in attempts to initiate engine ignition, that is the second magneto running points circuit 84 is grounded and the first magneto running/starting points produce current impulses, augmented by the starter vibrator 14, to the second engine spark plugs. Once the second engine 50 is at maximum start-up rotational speed, the pilot engages auxiliary starter switches 24,26 to the engaged position shown in FIG. 3. This breaks the second magneto running points circuit 84 to the ground G otherwise caused by the start switch 12C, and disengages the first magneto retard breaker circuit 86 otherwise engaged by the contacts 12A,12B of the start switch 12A,12B,12C,12D. The second magneto 54 and first magneto 52 thereupon simultaneously provide current impulses via their respective running points only to the second engine spark plugs to attempt engine ignition. Since the second engine starter 18 is engaged before engagement of the auxiliary ignition switches 24,16, the engine 50 is rotating before the current impulses are provided by the first and second magnetos 52,54. This reduces the potential of kickback of the engine 50 at the relatively slow rotational speed of the magnetos 3,4 at initial engagement of the engine starter motor 18.

Figure 4:
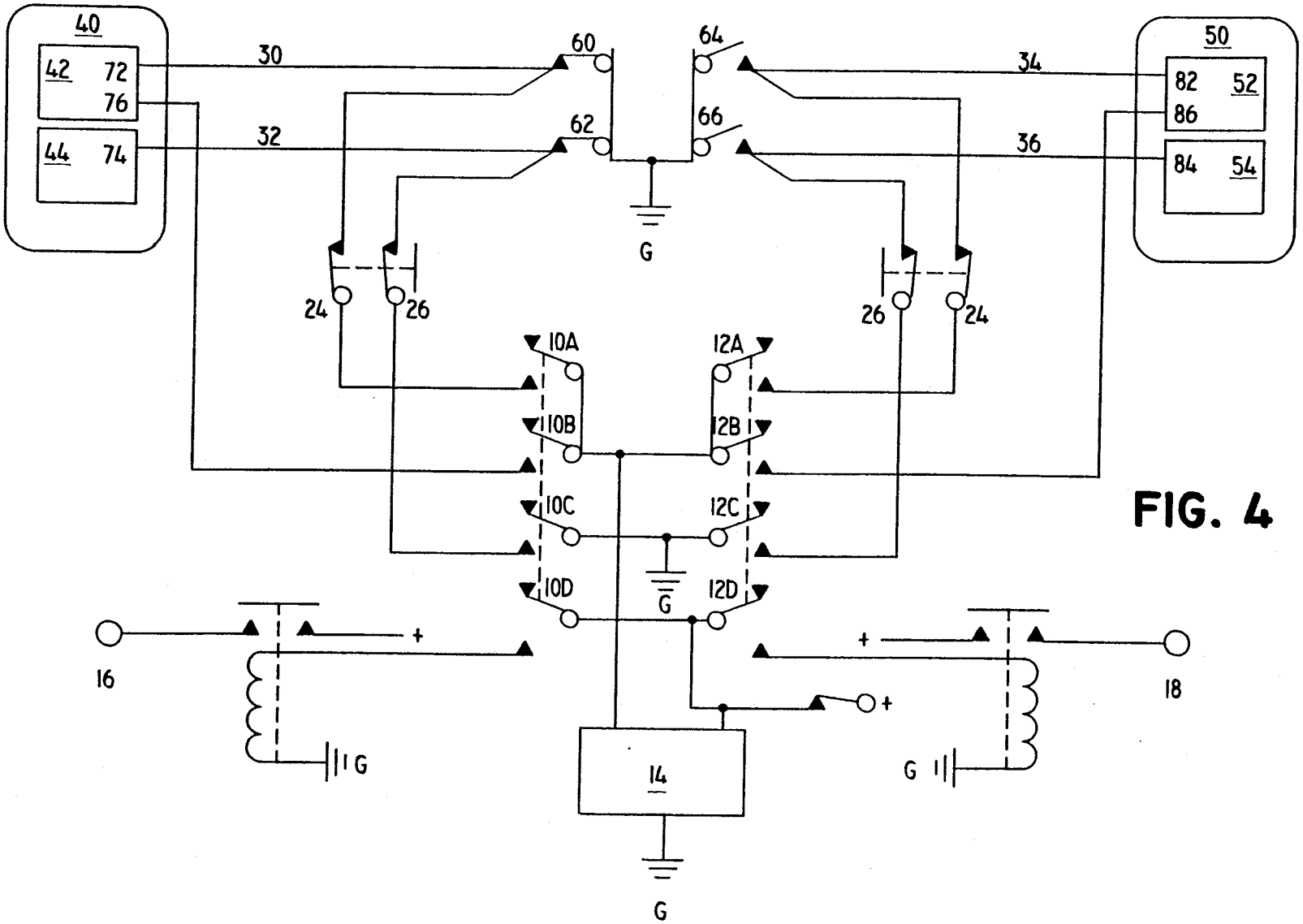
FIG. 4 is a schematic wiring diagram of FIG. 3 showing the auxiliary ignition system switches set for normal running operation of the second engine.

Once the engine 50 starts, the pilot first disengages the engine starter motor 18 via start switch 12A,12B,12C,12D and then disengages the auxiliary ignition switches 24,26 to the positions as shown in FIG. 4. The engine 50 will thereafter continue to run until and unless the magnetos 52,54 are both grounded by their respective magneto switches 64,66. The first engine 40 may be started in a similar fashion with its auxiliary ignition system switches 24,26 as necessary.

Once the engines 40,50 are started, the auxiliary ignition switches have no effect whatsoever on the normal running operation of the engines 40,50. Even if the auxiliary ignition switches 24,26 are inadvertently left in the engaged position as shown in FIG. 3 for the second engine auxiliary ignition switches, the aircraft's running circuits are completely unaffected.

In summary, the auxiliary ignition system of the present invention operates to counteract or defeat the intended functions of the prior art conventional aircraft starter vibrator ignition system, and provides a safe and reliable means and method of auxiliary ignition of the engine or engines upon failure of the first magneto starting circuit, a failure of the starter vibrator, or other adverse conditions such as inclement weather. This allows the aircraft to be safely started and operated until the necessary repairs can be made to the defective or damaged portion of the conventional ignition system.

Even though particular embodiments of the present invention have been illustrated and described herein, it is not intended to limit the invention and changes and modifications may be made therein within the scope of the following claims.

What is claimed is:

1. An auxiliary ignition system, comprising: a first magneto having a normal operating mode and a start-up mode; a second magneto having a normal operating mode and a start-up mode; a start switch operably wired to said first and second magnetos, engagement of said start switch activates said second magneto start-up mode and activates said first magneto start-up mode; and auxiliary ignition switches operably connected to said start switch, engagement of said auxiliary ignition switches and said start switch causes said first and second magnetos to initiate engine ignition in their respective normal operating mode.

2. The auxiliary ignition system of claim 1, wherein said first magneto further includes running points operable during said first magneto normal operating mode and starting points in series with said first magneto running points operable during said first magneto start-up mode, said second magneto further includes running points operable during said second magneto normal operating mode and being grounded and nonoperable during said second magneto start-up mode.

3. The auxiliary ignition system of claim 2, wherein said auxiliary ignition switches are operably connected in series between said start switch and said first magneto and said second magneto, respectively.

4. The auxiliary ignition system of claim 3, wherein the engagement of said auxiliary ignition switches after the engagement of said start switch disables said first magneto starting points in said first magneto start-up mode and allows only said first magneto running points to operate in said first magneto start-up mode, and removes said second magneto running points from ground in said second magneto start-up mode to allow said second magneto running points to operate in said second magneto start-up mode.

5. The auxiliary ignition system of claim 4 wherein said first and second magnetos are operably wired to an engine having spark plugs, said magnetos provide impulses to said spark plugs in said first and second magneto normal operating mode, and only said first magneto providing current impulses to said spark plugs in said first and second magneto start-up mode.

6. An auxiliary ignition system for aircraft, comprising:

an engine including spark plugs, a first magneto and a second magneto, said magnetos operably connected to said spark plugs to provide current impulses to said spark plugs for engine ignition and operation upon rotation of said magnetos; said magnetos having a start-up condition and an operating condition, said first magneto including starting points and running points wired in series and operable during said start-up condition to provide said current impulses in attempting engine ignition, only said running points of said first magneto are operable during said operating condition to provide said current impulses, said second magneto including running points to provide said current impulses during said operating condition, said second magneto start-up condition disengages said second magneto to prevent said second magneto from providing said current impulses;

a starter motor including a start switch, said starter motor being operably connected to said engine whereby engagement of said starter motor with said start switch rotates said magnetos;

said start switch includes a plurality of contacts whereby engagement of said plurality of contacts by said start switch places said magnetos in said start-up condition, and disengagement of said plurality of contacts by said start switch disengages said starter motor and said magnetos start-up condition;

a starter vibrator operably connected to said start switch and said first magneto, whereby engagement of said start switch engages said starter vibrator to provide an enhanced current impulse to said spark plugs via said first magneto; and first and second auxiliary ignition switches operably connected to said running points of said first and second magnetos, respectively, and located between said magnetos and said plurality of contacts, where engagement of said auxiliary ignition switches after engagement of said plurality of contacts by said start switch disengages said starting points of said first magneto and engages said running points of said second magnetos to provide current impulses by said first and second magneto running points to said spark plugs for engine ignition.

7. A method of starting a two magneto engine operating in a normal starting condition in which a starting circuit disables the second of said two magnetos, and said first magneto is energized with a supplemental energy source comprising the steps of:

disabling said starting circuit by disabling the portion of said starting circuit which disables said second magneto to cause said second magneto to fire in an operating condition during starting, and by simultaneously disabling the portion of said starting circuit which energizes said first magneto with said supplemental energy source to cause said first magneto to fire in an operating condition during starting.

8. The method of claim 7, wherein said starting circuit is engaged by a start switch, and said starting circuit is disabled by auxiliary ignition switches operably connected in said starting circuit between said two magnetos, respectively, and said start switch.

9. The method of claim 8, wherein said start switch includes multiple contacts operating in tandem.

10. The method of claim 9, wherein said auxiliary switches are between said two magnetos, respectively, and said multiple contacts.

11. The method of claim 10, wherein said second magneto includes running points operable in said second magneto operating condition and grounded and inoperable in said normal starting condition by said starting circuit.

12. The method of claim 11, wherein said first magneto includes running points and starting points wired in series, both said first magneto running and starting points being operable when energized by said supplemental energy source in said normal starting condition, and only said first magneto running points being operable upon said disabling the portion of said starting circuit which energizes said first magneto with said supplemental energy source to cause said first magneto to fire in an operating condition during starting.

* * * * *